US006325028B1

(12) United States Patent
Albanello et al.

(10) Patent No.: US 6,325,028 B1
(45) Date of Patent: Dec. 4, 2001

(54) INTERNAL COMBUSTION ENGINES WITH VARIABLE VALVE ACTUATION

(75) Inventors: Stefano Albanello, Chatillon; Lorentino Macor, Beinasco; Francesco Vattaneo, Pancalieri, all of (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 09/672,023

(22) Filed: Sep. 29, 2000

(30) Foreign Application Priority Data

Oct. 6, 1999 (IT) ..... TO99A0859

(51) Int. Cl.[7] ..... F01L 1/16; F01L 9/02
(52) U.S. Cl. ..... 123/90.12; 123/90.49
(58) Field of Search ..... 123/90.12, 90.13, 123/90.15, 90.16, 90.48, 90.49

(56) References Cited

U.S. PATENT DOCUMENTS 4,671,221 * 6/1987 Geringer et al. ..... 123/90.16
4,889,085 * 12/1989 Yagi et al. ..... 123/90.12
5,193,495 * 3/1993 Wood, III ..... 123/90.12
5,216,988 * 6/1993 Taxon ..... 123/90.12
5,275,136 * 1/1994 Schechter et al. ..... 123/90.12
5,531,192 * 7/1996 Feucht et al. ..... 123/90.12
5,577,468 * 11/1996 Weber ..... 123/90.12
5,638,781 * 6/1997 Sturman ..... 123/90.12
6,135,073 * 10/2000 Feucht et al. ..... 123/90.12
6,192,841 * 2/2001 Vorih et al. ..... 123/90.12

* cited by examiner

*Primary Examiner*—Weilun Lo
(74) *Attorney, Agent, or Firm*—Sughrue, Mion, Zinn, Macpeak & Seas, PLLC

(57) ABSTRACT

In an internal combustion engine having a hydraulic system for valve variable actuation and a hydraulic braking device for slowing down the valve during the final portion of its closing travel, this hydraulic braking device is arranged so as to be substantially insensitive to variations in viscosity of the fluid resulting from variations of the temperature.

5 Claims, 3 Drawing Sheets

INTERNAL COMBUSTION ENGINES WITH VARIABLE VALVE ACTUATION

Figure 1:
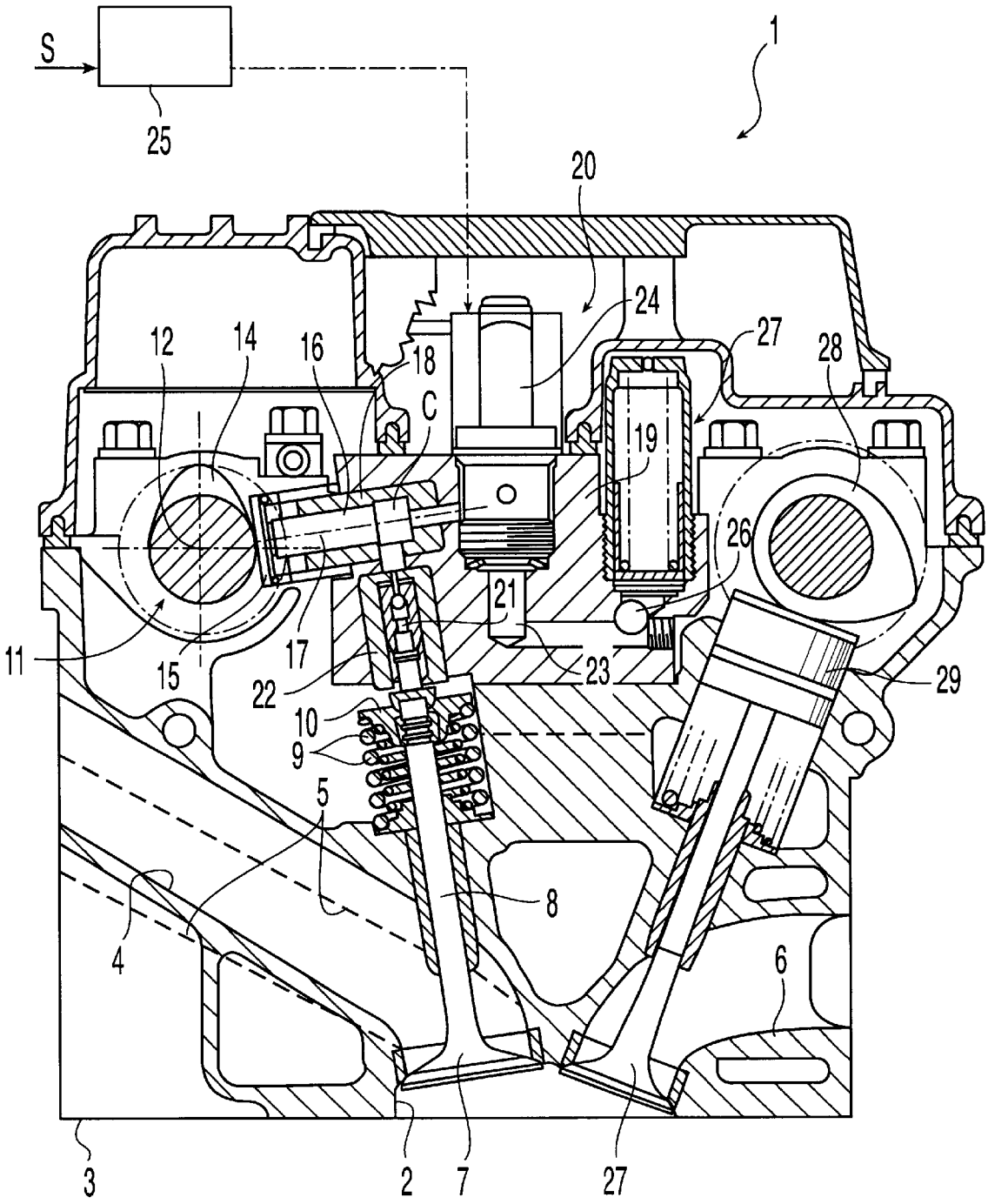
Fig. 1 (Prior Art)

The present invention relates to internal combustion engines of the type comprising:

at least one intake valve and at least one exhaust valve for each cylinder, each provided with respective spring means biasing the valve to a closed position, for controlling communication between respective intake and exhaust conduits and a combustion chamber, a cam shaft for actuating the intake and exhaust valves of the engine cylinders by means of respective tappets, each intake valve and each exhaust valve being driven by a cam of said cam shaft, wherein at least one of said tappets drives the respective intake or exhaust valve, against the action of said biasing spring means, with the interposition of hydraulic means including a pressure fluid chamber, said pressure fluid chamber being able to be connected through a solenoid valve to an outlet channel, for uncoupling the valve from the respective tappet and cause a quick closing of the valve, under the action of the respective biasing spring means, said hydraulic means further comprising a piston associated with a stem of the valve and slidably mounted within a guiding bush, said piston facing a variable volume chamber defined thereby inside the guiding bush, said variable volume chamber being in communication with the pressure fluid chamber by means of an end aperture of said guiding bush, said piston having an end appendage adapted to be inserted into said end aperture during the final portion of the travel of the piston corresponding to closing of the valve, in order to reduce the communication passage between said variable volume chamber and said pressure fluid chamber, so as to slow down the travel of the valve in proximity of its closed position.

An engine of the above indicated type is disclosed for example in European patent application EP-A0 803 642 of the same Applicant.

The above-described system provides a variable control of the opening of the intake and/or exhaust valves without altering the mechanical parts which drive the displacement of the valves. As a matter of fact, while in a conventional timing system the movement of each intake or exhaust valve is only determined by the geometry of the mechanical parts which drive the valve (cam, tappet, and rocker arm, if any) in the above described known system the solenoid valve controlling the pressure chamber associated with a given valve can be driven so as to open at any moment this is desired (typically this solenoid valve is controlled by electronic control means depending upon one or more parameters of operation of the engine), so as to empty the above mentioned chamber from fluid under pressure (usually the lubrication oil of the engine) and cause quick closing of the intake or exhaust valve, under the action of the respective biasing spring means, even during a stage in which the respective cam would tend to keep the valve opened.

As already indicated above, the known solution provides that with the valve there is associated a piston slidably mounted within a guiding bush. The piston faces a variable volume chamber defined thereby inside the guiding bush and communicating with the pressure fluid chamber through an end aperture of the guiding bush. In order to slow down the travel of the valve in proximity of its closed position, so as to avoid damages due to an impact of the valve against its seat at a too great speed when the pressure chamber is emptied in order to uncouple the valve from the respective tappet, the above mentioned piston has a tubular end appendage adapted to be inserted into the above mentioned end aperture during the final portion of the closing travel of the valve, in order to restrict the communication passage between the variable volume chamber and the pressure fluid chamber, so as to brake the valve in proximity of its closed position.

Studies and tests conducted by the Applicant however have shown that the braking effect obtained thereby can become excessive if fluid under pressure (typically the lubrication oil of the engine) has a high viscosity due to a low value of its temperature. Thus, for example, when the ambient temperature is low, such as in the order of −10° C., and the engine has not reached a condition of normal operation following a cold start, the viscosity of the oil may be such as to render the time required for closing the valve too long. For example, lubrication oil which in normal operative conditions may have a kinematic viscosity in the order of 15 centistokes, may arrive to have a viscosity of 4,000 centistokes at a temperature of −20° C.

In order to overcome this drawback, the invention provides an engine of the type indicated at the beginning of the present description, characterised in that said tubular end appendage has at its front a diametrical slot intercepting the inner cavity of said tubular end appendage and opening both on the front end and on the two opposite sides of this end tubular appendage, and in that the wall of said end tubular appendage has a radial hole opening on one side on the inner cavity of the tubular appendage and on the other side on the lateral wall of the appendage, this hole including a radially inner portion having a predetermined reduced diameter.

The provision of the above mentioned diametrical slot causes a gradual reduction of the cross-section of the oil flowing area during the closing travel of the valve and hance a smooth and progressive braking action. Furthermore, the above-mentioned portion of reduced diameter of the above mentioned radial hole is precisely chosen in such a way as to determine the required approaching speed of the valve to its seat. As a matter of fact, once the above mentioned diametrical slot comes out of communication with the variable volume chamber during the final portion of the valve travel, the above mentioned hole of predetermined diameter constitutes the prevailing path for the oil to escape from the variable volume chamber (apart from the very narrow coupling clearance between the piston and the bush).

The above-described measures dramatically reduce the sensitivity of the device to variations of temperature of the fluid. All the other conditions being the same, for a determined geometry of the hole of reduced diameter, there is a specific viscosity value of the fluid above which the fluid flow from turbulent becomes laminar. In the former case the viscosity does not affect the flow rate, whereas in the latter case the viscosity strongly affects the fluid flow rate. The geometrical shape for which the above mentioned transition occurs at the highest values of viscosity is a circular hole of short length. It is just to reduce the length of the hole as much as possible that in the invention the portion of the hole with reduced diameter is followed by a hole portion of a sufficiently enlarged diameter.

Therefore, the present invention keeps the approaching speed of the valve to its seat as much uniform as possible when the temperature, and hence the fluid viscosity, varies, since by the above-mentioned measures, the fluid motion is always substantially of turbulent type.

Therefore, the present invention efficiently solves the above mentioned problems, while insuring a narrow variability of the closing timing of the valve within a large thermal range, so that the engine can be controlled efficiently in any condition of operation.

Figure 2:
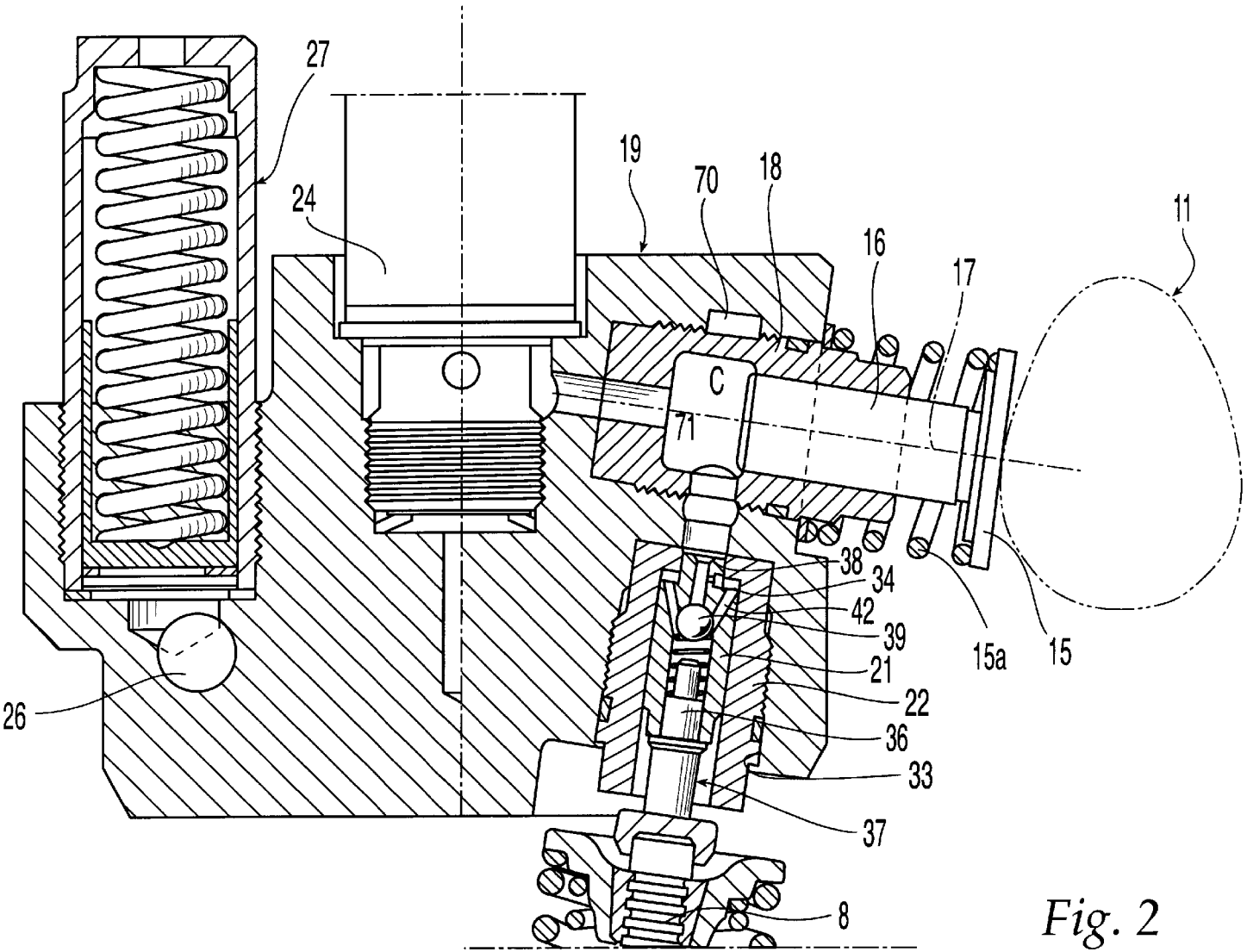
Figure 3:
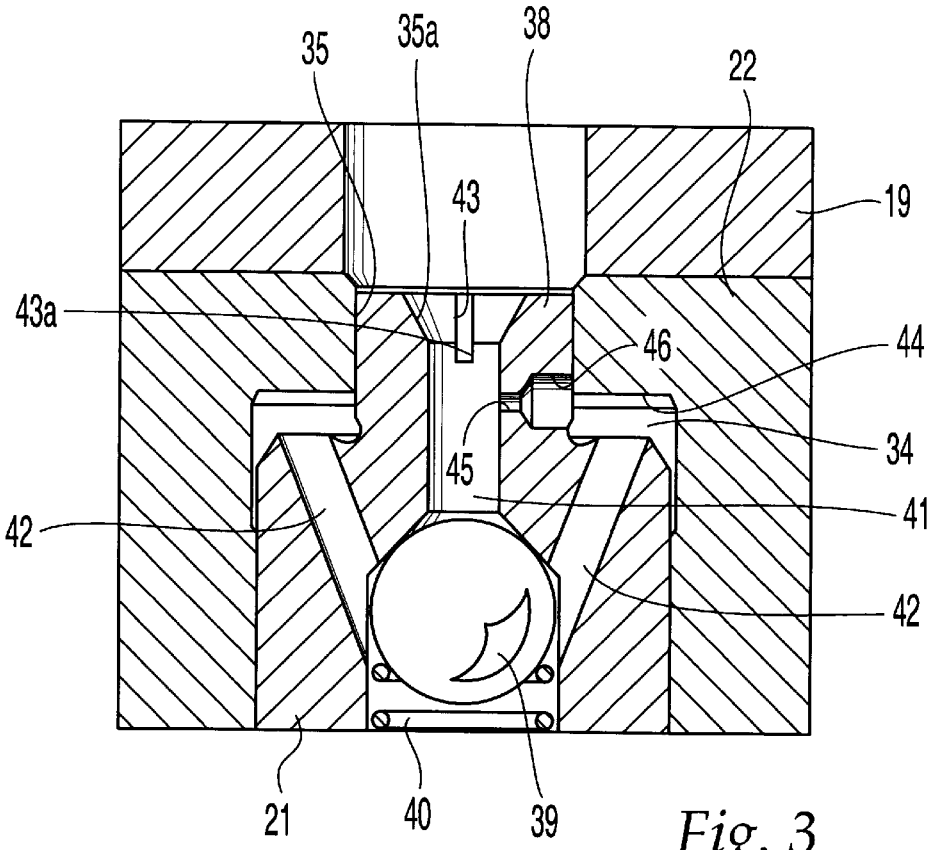
Figure 4:
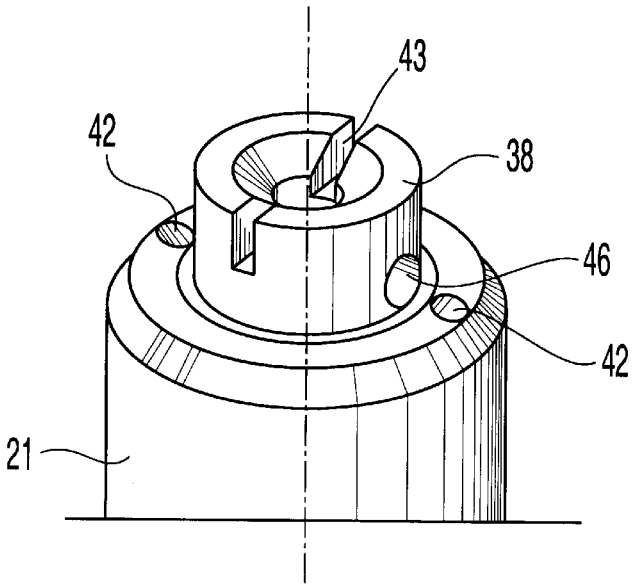

Further features and advantages of the invention will become apparent from the description which follows with reference to the annexed drawings, given purely by way of non-limiting example, in which:

FIG. 1 is a cross-sectional view of a head of an internal combustion engine according to an embodiment known from European patent application EP-A-0 803 642 of the same Applicant, FIG. 2 is a cross-sectional view at an enlarged scale of a detail of FIG. 1, modified according to the present invention, FIG. 3 shows a detail of FIG. 2 at a further enlarged scale, and FIG. 4 shows a perspective view of a detail of FIG. 3.

With reference to FIG. 1, the internal combustion engine described in previous European application EP-A-0 803 642 of the same Applicant is a multi-cylinder engine, such as an engine having five cylinders in line, comprising a cylinder head 1. The head 1 comprises, for each cylinder, a cavity 2 formed in the bottom surface 3 of the head 1, defining the combustion chamber, in which two intake conduits 4, 5 and two exhaust conduits 6 open. The communication of the two intake conduits 4, 6 with the combustion chamber 2 is controlled by two intake valves 7, of a conventional mushroom-shaped type, each comprising a stem 8 slidably mounted within the body of the head 1. Each valve 7 is biased towards its closed position by springs 9 interposed between an inner surface of the head 1 and an end cup element 10 of the valve. The opening of the intake valves 7 is controlled, in a way which will be described in the following, by a camshaft 11 rotatably mounted around an axis 12 within supports of the head 1 and comprising a plurality of cams 14 for actuating the valves.

Each cam 14 for controlling an intake valve 7 co-operates with the plate 15 of a tappet 16 slidably mounted along an axis 17 substantially directed at 90° with respect to the axis of valve 7, within a bush 18 carried by a body 19 of a pre-assembled sub-unit 20 incorporating all the electric and hydraulic devices associated with the actuation of the intake valves, according to what is described in detail in the following. The tappet 16 is able to apply a force to stem 8 of valve 7, so as to cause opening of the latter against the action of spring means 9, by means of fluid under pressure (typically oil coming from the engine lubrication circuit) which is present in a chamber C and a piston 21 slidably mounted in a cylindrical body constituted by a bush 22 which is also carried by the body 19 of the sub-unit 20. Also in the known solution shown in FIG. 1, the chamber of fluid under pressure C associated with each intake valve 7 can be put in communication with an outlet channel 23 through a solenoid valve 24. The solenoid valve 24, which can be of any known type adapted for the operation illustrated herein, is controlled by electronic control means, diagrammatically indicated by 25, depending upon signals S indicative of parameters of operation of the engine, such as the position of the accelerator pedal, and the rotational speed of the engine. When the solenoid valve 24 is opened, the chamber C comes in communication with channel 23, so that the fluid under pressure which is present in chamber C flows into this channel thus providing uncoupling of the tappet 16 of the respective intake valve 7, which therefore comes back quickly to its closed position, under the action of the biasing springs 9. By controlling the communication between chamber C and the outlet channel 23, it is thus possible to vary at will the timing and length of the opening travel of each intake valve 7.

The outlet channels 23 of the various solenoid valves 24 all open on a common longitudinal channel 26 communicating with two pressure accumulators 27, only one of which is visible in FIG. 1. All the tappets 16 with the associated bushes 18, the pistons 21 with the associated bushes 22, the solenoid valves 24 and the associated channels 23, 26 are carried and formed in the above mentioned body 19 of the reassembled subassembly 20, for an advantageously quicker and easier assembly of the engine.

The exhaust valves 27 associated with each cylinder are controlled, in the embodiment shown in FIG. 1, in a conventional manner by a camshaft 28 through respective tappets 29.

FIG. 2 shows at an engaged scale the body 19 of the pre-assembled unit 20 modified according to the present invention.

FIG. 2 shows in detail the structure of piston 21. Piston 21, in a way known per se, has a tubular body slidably mounted within the bush 22 and defining within this bush a variable volume chamber 34 which communicates with the chamber C of fluid under pressure through an end central aperture 35 formed in bush 22. The opposite end of the piston 21 is fitted over an end portion 36 of a stem 37 associated to stem 8 of the valve 7 (FIG. 1). During normal operation, when the cam 14 drives the aperture of valve 7, it causes the movement of the tappet 16 determining a transfer of fluid under pressure from chamber C to chamber 34 and the resulting aperture of valve 7 against the action of spring 9. The chamber C communicates with an annular chamber 30 through radial holes 71 formed in bush 18. The annular chamber 70 communicates with the cylinders which are associated with the two valves 7. According to the known art, a quick closing of the valve can be obtained by emptying the chamber C from oil under pressure by opening the solenoid valve 24. In this case, the valve 7 returns rapidly to its closed position due to the action of spring 9. In order to avoid a too strong impact of the valve 7 against its seat, in proximity of its fully closed position, valve 7 is slowed down. This result is obtained, also according to the prior art, by braking hydraulic means constituted by an end central appendage 38 provided on the tubular piston 21 and adapted to be inserted into the aperture 35 of bush 22 during the final portion of the closing travel of the valve. During the closing travel, the piston 21 is moved upwardly (with reference to FIG. 3) and the variable volume chamber 34 decreases in its volume, so that oil under pressure is pushed towards chamber C. When the end appendage 38 of piston 21 enters into aperture 35, a return flow of oil under pressure from chamber 34 to chamber C occurs, in the case of the prior art, through a small clearance (not visible in the drawing) between appendage 38 and the wall of the aperture 35. The oil flow is thus greatly slowed down and the valve travel is accordingly also slowed down. Also according to the prior art, with the cylinder 21 there is also associated a one-way valve comprising a ball shutter 39 forced inside the tubular body of piston 21 by a spring 40 towards a position obstructing an end central hole 41 of piston 21, which extends from inner cavity of piston 21 and opens on the end facing chamber C. The inner chamber of piston 21 also communicates with lateral passages 42 which open on the end annular surface of piston 21 which surrounds the appendage 38 and faces chamber 34. As already indicated, the above-described structure is also known. The function of shutter 39 is the following. During the closing travel of the valve 7, the shutter 39 is kept in its closed position by spring 40 and by the oil pressure in chamber 34 when the appendage 38 is inside aperture 35 and the operation of the device is that described already above. When chamber C is emptied from oil under pressure through the solenoid valve 20, the valve 7 rapidly returns to its closed position due to the action of springs 9, but is slowed down immediately before reaching its fully closed position, due to the engagement of appendage 38 into aperture 35, so as to avoid a strong impact of the valve against its seat. When the valve is instead opened, to provide a quick transmission of the force applied by cam 14 through tappet 16 to piston 21 the shutter 39 is moved to its opened position, against the action of spring 40, due to the force applied by fluid under pressure coming from chamber C. The opening of shutter 39 causes pressure to be communicated through the hole 41 and the lateral holes 42 directly to the end annular surface of piston 21 which faces the chamber 34, so that a high force is applied to piston 21 even when the appendage 38 is still inside the aperture 35.

As indicated at the beginning of the present description, in the above described known solutions, there is the problem that the time required for closing valve 7 may become too long, due to the action of the braking hydraulic means described above (aperture 35 and appendage 38) if the lubrication oil has a very high viscosity, such as in the case of a cold start of the engine with a very low ambient temperature.

In order to overcome this drawback, this end appendage 38 of the piston 22 has a diametrical slot 43 (see FIGS. 3, 4) which intercepts the hole 41 and opens both on the end front surface of the end appendage 38, and on the two opposite sides of this appendage. The connecting aperture 35 comprises a cylindrical hole which opens on the end of appendage 38 by means of a conical mouth 35*a*. In the illustrated example, the diametrical slot 43 has a height greater than that of the conical mouth 35*a*. Due to the presence of slot 43, during the final portion of the closing travel of the valve, the variable volume chamber 34 can communicate with the pressure chamber C through said slot 43 as long as the lower edge of the slot (designated by 43*a*) is located below (with reference to FIG. 3) the upper plane 44 of the variable volume chamber 34. As already indicated in the foregoing, a gradual reduction is thus obtained of the cross-section of the oil flowing area during the closing travel of the valve and hance a smooth and progressive braking action is achieved.

According to the invention, the hole of the end appendage 38 has a radial passage including an end portion constituted by a hole of predetermined reduced diameter 45 which opens on the hole 41 of appendage 38. The hole 45 is followed by a hole of enlarged diameter 46 opening on the variable volume chamber 34. The diameter of hole 45 is precisely chosen in such a way as to determine the required approaching speed of the valve to its seat. Indeed, once the diametrical slot 43 has been completely covered by the wall of hole 35 of bush 22, the hole of reduced diameter 45 constitutes the single path for the oil to escape from chamber 34, apart from the very narrow coupling clearance between the end appendage 38 and the hole 35 formed in bush 22. In particular, due to this latter measure, as already indicated above, a great reduction is obtained of the sensitivity of the device to variations of temperature of the fluid. As also already indicated above, the provision of a hole of reduced diameter 45, further having also a small length (obtained by providing the hole 46 of enlarged diameter) enables the value of viscosity of the fluid above which transition from turbulent motion to laminar motion occurs to be particularly high. In this manner, the variations in viscosity of the fluid caused by the temperature do not affect the characteristics of the fluid flow, which always remains substantially turbulent. Therefore, the braking action remains substantially uniform both with cold engine and with warm engine. It is thus avoided to have an excessive braking action at low temperatures, which would cause a too low closing movement of the valve, or to have a too weack braking action in conditions of warm engine, which would cause problems of mechanical resistance of the parts and intolerable noise.

Naturally, while the principle of the invention remains the same, the details of construction and the embodiments may widely vary with respect to what has been described and illustrated purely by way of example, without departing from the scope of the present invention.

What is claimed is:

1. Internal combustion engine, comprising:

at least one intake valve and at least one exhaust valve for each cylinder, each provided with respective spring means biasing the valve to its closed position, for controlling communication between respective intake and exhaust conduits and a combustion chamber, a cam shaft for actuating the intake and exhaust valves of the engine cylinders by means of respective tappets, each intake valve and each exhaust valve being driven by a cam of said cam shaft, wherein at least one of said tappets drives the respective intake or exhaust valve, against the action of said biasing spring means, with the interposition of hydraulic means including a pressure fluid chamber, said pressure fluid chamber being adapted to be connected through a solenoid valve to an outlet channel, in order to uncouple the valve from the respective tappet and cause quick closing of the valve, under the action of the respective biasing spring means, said hydraulic means further comprising a piston associated with the stem of the valve and slidably mounted within a guiding bush, said piston facing a variable volume chamber defined thereby inside the guiding bush, said variable volume chamber being in communication with the pressure fluid chamber through a connecting aperture formed at one end of said guiding bush, said piston having a tubular end appendage adapted to be inserted into said connecting aperture during the final portion of the travel of the piston corresponding to closing of the valve, in order to restrict the connecting aperture between said variable volume chamber and said pressure fluid chamber, so as to slow down the travel of the valve in proximity of its closed position, wherein said tubular end appendage has at its front end a diametrical slot intercepting an inner cavity of the tubular appendage and opening both on the end and on two opposite sides of said appendage, and wherein a wall of said tubular end appendage has a radial hole opening at one end on the inner cavity of the tubular appendage, and the other end on a lateral wall of the appendage, this hole including a radially inner portion having predetermined reduced diameter.

2. Internal combustion engine according to claim 1, wherein said radial hole has a radially outer portion of enlarged diameter with respect to said portion of reduced predetermined diameter.

3. Internal combustion engine according to claim 1, wherein said radial hole has a circular crosssection.

4. Internal combustion engine according to claim 1, wherein said diametrical slot has two planar parallel and facing walls and a bottom wall orthogonal thereto.

5. Internal combustion engine according to claim 1, wherein in the end position of said piston corresponding to the fully closed condition of the valve, the ends of said diametrical slot are fully covered by the wall of said aperture in which the end appendage is slidable.

* * * * *